US005605528A

United States Patent [19]

Larson

[11] Patent Number: 5,605,528

[45] Date of Patent: Feb. 25, 1997

[54] PAPER COLLECTOR WITH RESILIENT PAPER SUPPORT ASSEMBLY FOR FACILITATING REFOLDING AND RESTACKING FANFOLD PAPER DISCHARGED FROM A CONTINOUS FORM PRINTER OR THE LIKE

[75] Inventor: Reese G. Larson, Spokane, Wash.

[73] Assignee: Output Technology Corporation, Spokane, Wash.

[21] Appl. No.: 377,933

[22] Filed: Jan. 23, 1995

[51] Int. Cl.[6] ..... B31B 1/26

[52] U.S. Cl. ..... 493/411; 493/412; 493/413

[58] Field of Search ..... 493/411, 412, 493/413, 414, 415

[56] References Cited

U.S. PATENT DOCUMENTS

| | | | |
|---|---|---|---|
| 1,121,370 | 12/1914 | Karlberg et al. . | |
| 1,210,465 | 1/1917 | Gubelman | 271/86 |
| 1,781,023 | 11/1930 | Levy . | |
| 1,985,676 | 12/1934 | Hand . | |
| 2,351,571 | 6/1944 | Burlin | 211/50 |
| 2,495,994 | 1/1950 | Ward et al. . | |
| 2,687,301 | 8/1954 | Sooy et al. | 271/209 |
| 3,124,350 | 3/1964 | Huffman | 270/79 |
| 3,160,413 | 12/1964 | Faeber | 271/86 |
| 3,547,430 | 12/1970 | Assony | 270/79 |
| 3,658,323 | 4/1972 | Matwey | 271/86 |
| 3,761,080 | 9/1973 | Larson | 271/88 |
| 3,793,950 | 2/1974 | Kaneko et al. | 101/142 |
| 3,820,700 | 6/1974 | Quirijnen | 493/414 |
| 3,912,252 | 10/1975 | Stephens | 270/79 |
| 4,151,985 | 5/1979 | Gladow | 270/79 |
| 4,172,592 | 10/1979 | Müeller et al. | 270/61 |
| 4,226,410 | 10/1980 | McIntosh, Sr. et al. | 270/61 |
| 4,332,581 | 6/1982 | Thompson | 493/413 |
| 4,400,124 | 8/1983 | Greller | 414/43 |
| 4,508,527 | 4/1985 | Uno et al. | 493/357 |
| 4,631,552 | 12/1986 | Kobayashi | 346/136 |
| 4,707,156 | 11/1987 | Clark | 400/613.2 |
| 4,820,250 | 4/1989 | Bunch, Jr. | 493/414 |
| 4,898,374 | 2/1990 | Vermaat | 271/178 |
| 4,900,172 | 2/1990 | Svoboda | 400/605 |
| 4,911,421 | 3/1990 | Hannon | 271/161 |
| 4,917,657 | 4/1990 | Bunch, Jr. | 493/8 |
| 4,941,654 | 7/1990 | Kelley | 271/209 |
| 4,976,677 | 12/1990 | Siversson | 493/413 |
| 5,030,192 | 7/1991 | Sager | 493/411 |
| 5,074,836 | 12/1991 | Fechner et al. | 493/411 |
| 5,074,837 | 12/1991 | Blanton, III et al. | 493/412 |
| 5,082,382 | 1/1992 | Negoro et al. | 400/613.2 |
| 5,116,012 | 5/1992 | Offenhauer et al. | 248/452 |
| 5,123,894 | 6/1992 | Bergeman et al. | 493/410 |
| 5,149,075 | 9/1992 | Crowley et al. | 270/39 |
| 5,238,316 | 8/1993 | Moore et al. | 400/613.2 |
| 5,358,345 | 10/1994 | Damitio | 400/613.2 |

OTHER PUBLICATIONS

"The ATC M100 . . . A Paper Stacking Solution for Continuous Form Laser Printers", Analog Technology Corp., Duarte, CA (1993).

*Primary Examiner*—J. Elpel
*Assistant Examiner*—Darren Ark
*Attorney, Agent, or Firm*—Wells, St. John, Roberts, Gregory & Matkin, P.S.

[57] ABSTRACT

A printer output paper collector 70 is described for refolding and stacking fanfold paper 20 that is discharged from a continuous form printer 12. The collector 70 includes a base 72 with opposing end walls 74 and 76 having guiding surfaces for receiving the fold lines or ends of the sheets and guiding the sheets downward to progressively form the restack. The collector 70 has a resilient support assembly 82 that includes a central pedestal 84 extending above the base 72 for supporting the restack above the base 72. A resilient plastic sheet member 102 is mounted on the pedestal 84 with cantilevered wing sections 108 and 110 extending from the pedestal 84 outward toward the end walls 74, 76 to resiliently support the restack adjacent the fold lines. As the height and weight of the restack increases, the additional weight causes the wing sections 108, 110 to deflect downward to maintain the top layer 62 of the restack substantially flat to facilitate the refolding of the sheets 26.

9 Claims, 8 Drawing Sheets

PAPER COLLECTOR WITH RESILIENT PAPER SUPPORT ASSEMBLY FOR FACILITATING REFOLDING AND RESTACKING FANFOLD PAPER DISCHARGED FROM A CONTINOUS FORM PRINTER OR THE LIKE

TECHNICAL FIELD

This invention relates to printer outfeed collectors particularly those concerned with refolding and restacking fanfold paper discharged from a continuous form printer, plotter or the like.

BACKGROUND OF THE INVENTION

Generally, continuous form computer printers or copiers are fed fanfold or zigzag-folded paper having a rather long length (continuous form) from a stack. Each panel or sheet of the continuous form is usually defined by transverse perforations or scoring. In the formation of a stack of fanfold continuous form paper, the paper is folded back and forth and creased at the perforations defining alternate fold lines until the desired stack height is obtained. As the paper is being oppositely folded at the perforations or scoring, the paper fibers are given an initial directional fold memory, to facilitate refolding and restacking of the fanfold paper at the original fold lines. Examples of fanfold paper folding devices are illustrated in the following United States patents:

| U.S. Pat. No. | Inventor(s) | Issue Date |
|---|---|---|
| 1,985,676 | Hand | Dec. 24, 1934 |
| 2,495,994 | Ward et al. | Jan. 31, 1950 |
| 3,124,350 | Huffman | Mar. 10, 1964 |
| 3,547,430 | Assony | Dec. 15, 1970 |
| 3,912,252 | Stephens | Oct. 14, 1975 |
| 4,151,985 | Gladow | May 1, 1979 |
| 4,332,581 | Thompson | Jun. 1, 1982 |
| 4,508,527 | Uno et al. | Apr. 2, 1985 |
| 4,820,250 | Bunch, Jr. | Apr. 11, 1989 |
| 4,917,657 | Bunch, Jr. | Apr. 17, 1990 |
| 4,976,677 | Siversson | Dec. 11, 1990 |
| 5,123,890 | Green, Jr. | Jun. 23, 1992 |
| 5,149,075 | Crowley et al. | Sep. 22, 1992 |

However the strength of the directional fold memory of the paper at each fold line is frequently weakened as the paper passes through the printer, making it difficult for the printer outfeed collector to reform the paper into a neat and orderly stack. The problem is particularly magnified when the fanfold paper is fed through an electrophotographic printer having high temperature fuser rollers that "iron out" the fold lines.

Several solutions have been proposed for engaging or reflecting the ironed out perforation edges as the paper leaves the printer to facilitate the orderly refolding and restacking of the continuous form paper. Two such proposed solutions to this problem have been suggested in the Negoro et al. U.S. Pat. No. 5,082,382, issued Jan. 21, 1992 and the Bergeman et al. U.S. Pat. No. 5,123,894 issued Jun. 23, 1992, along with other patents classified in U.S. Class 400, subclass 613.2

Analog Technology Corporation of Duarte, Calif., USA, is presently selling opposed moving belt devices under the brand name "Paper Cat", that are mountable along the sides of a printer outfeed collector with belt-teeth to engage and move the fold lines downward to assist in refolding fanfold paper discharged from the printer.

Applicant has invented a very clever and inexpensive "Printer Outfeed Paper Collector" that is quite effective in refolding and restacking fanfold paper discharged from a continuous form printer that is described in U.S. patent application Ser. No. 08/197,080 filed 16 February 1994, and issued as U.S. Pat. No. 5,358,345, issued Oct. 25, 1994.

However, despite the effectiveness of the Applicant's "Printer Outfeed Paper Collector", Applicant has found that, particularly for rather large stacks, the effectiveness may be diminished due to the excessive height build up at the perforated edges of the stack in relation to the center of the stack. Such differential build-up causes the upper layer of the stack to be seriously concave in shape, making refolding more difficult.

The problem is illustrated in FIGS. 1 and 2 in which a printer output paper collector, generally designated with the numeral 10 is designed to operate in conjunction with a continuous form printer 12 that has a paper input section 14 and a paper output section 16. The collector 10 refolds and restacks fanfold or zigzag paper 20 that is discharged from the output section 16 of the printer 12. The fanfold paper 20 is initially stored in a stack 22 adjacent the input section 14. The stack 22 is frequently contained in a stack container or bin 24. The fanfold paper 20 has sheets or panels 26 between fold or crease lines 28.

The continuous form printer 12 at the input section 14 includes an optional input guide 30 for guiding the paper from the stack 22 into the printer 12. An output guide 32 is mounted at the output section 16 for directing paper discharge from the printer in a downward orientation as illustrated.

The collector 10 includes a frame 40 having a base 41 that is generally floor mounted. The frame 40 includes a printer stand section 42 that extends upward from the base 41 to support the printer 12. The base 41 includes a restacking section 44 with a restack platform 46. The platform 46 has a paper break element 48.

The restacking section 44 further includes opposing end walls 50 and 52 that are positioned for receiving a restack 56 of the fanfold paper 20. Although not illustrated, the end walls 50 and 52 may be adjusted with respect to each other to accommodate different length sheets 26. The restacking section 44 also includes a back wall 54 and a front opening to permit a restack of the fanfold paper to be removed as necessary.

FIG. 1 illustrates the printer paper output collector 10 during the initial formation stage of restacking the fanfold paper. It should be noted that a lower or bottom layer 60 of the restack is bowed in an upward concave arc with sheet ends of the lower layer drooping downward engaging the platform 46. A top layer 62 of the restack 56 is beginning to be bowed with a downward concave arc in which the sheet ends 58 of the top layer 62 are vertically above the center of the top layer 62.

FIG. 2 illustrates the printer paper output collector 10 after the restack has obtain a substantial height. The lower layer 60 has maintained its initial contour while the top layer 62 of the restack has progressively increased its downward concave arc with a smaller radius of curvature. As illustrated, the sheet ends of the top layer 62 have increased their heights relative to the center of the top layer 62.

One technique to minimize the formation of the excessive concave bowing of the upper layers of a rather tall stack is to provide paper breaks at the bottom of the stack to cause the lower layers to conform to an upward concave configuration. Examples of such paper break devices are illustrated in the Moore et al. U.S. Pat. No. 5,238,316 granted Aug. 24, 1993, the McIntosh Sr. et al. U.S. Pat. No. 4,226,410 granted Oct. 7, 1980 and the Clark U.S. Pat. No. 4,707,157 granted Nov. 17, 1987. The Kelley U.S. Pat. No. 4,941,654 shows a paper break used in the stacking on successive single sheets.

Although such prior art devices may assist in refolding and restacking fanfold paper, they are either too expensive or are only moderately successful. For example, the paper break illustrated in the Moore et al. U.S. Pat. No. 5,238,316 is rather expensive and does not automatically adjust to various height stacks.

One of the advantages of the present invention is to provide a resilient paper support assembly that it is rather inexpensive and quite reliable and effective in both refolding and restacking fanfold paper discharged from the output of a computer printer independently of the height of the stack to maintain the top layer of the stack rather flat as subsequent sheets are being added.

These and other objects and advantages of the present invention will become apparent in reviewing the following detailed description of a preferred embodiment.

BRIEF DESCRIPTION OF THE DRAWINGS

Preferred embodiments of the invention are described below with reference to the accompanying drawings, which are briefly described below.

FIG. 5 is a vertical transverse cross-sectional view taken along line 5—5 in FIG. 4, illustrating the resilient paper support assembly supporting a small number of sheet layer of a restack with the top layer of the restack being substantially flat;

FIG. 6 is a vertical transverse cross-sectional view taken along line 6—6 in FIG. 4, which is similar to FIG. 5 with the top layer of the restack being substantially flat despite the addition of many more layers than shown in FIG. 5.

FIG. 7 is an isolated isometric view of a resilient support; and

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 3:
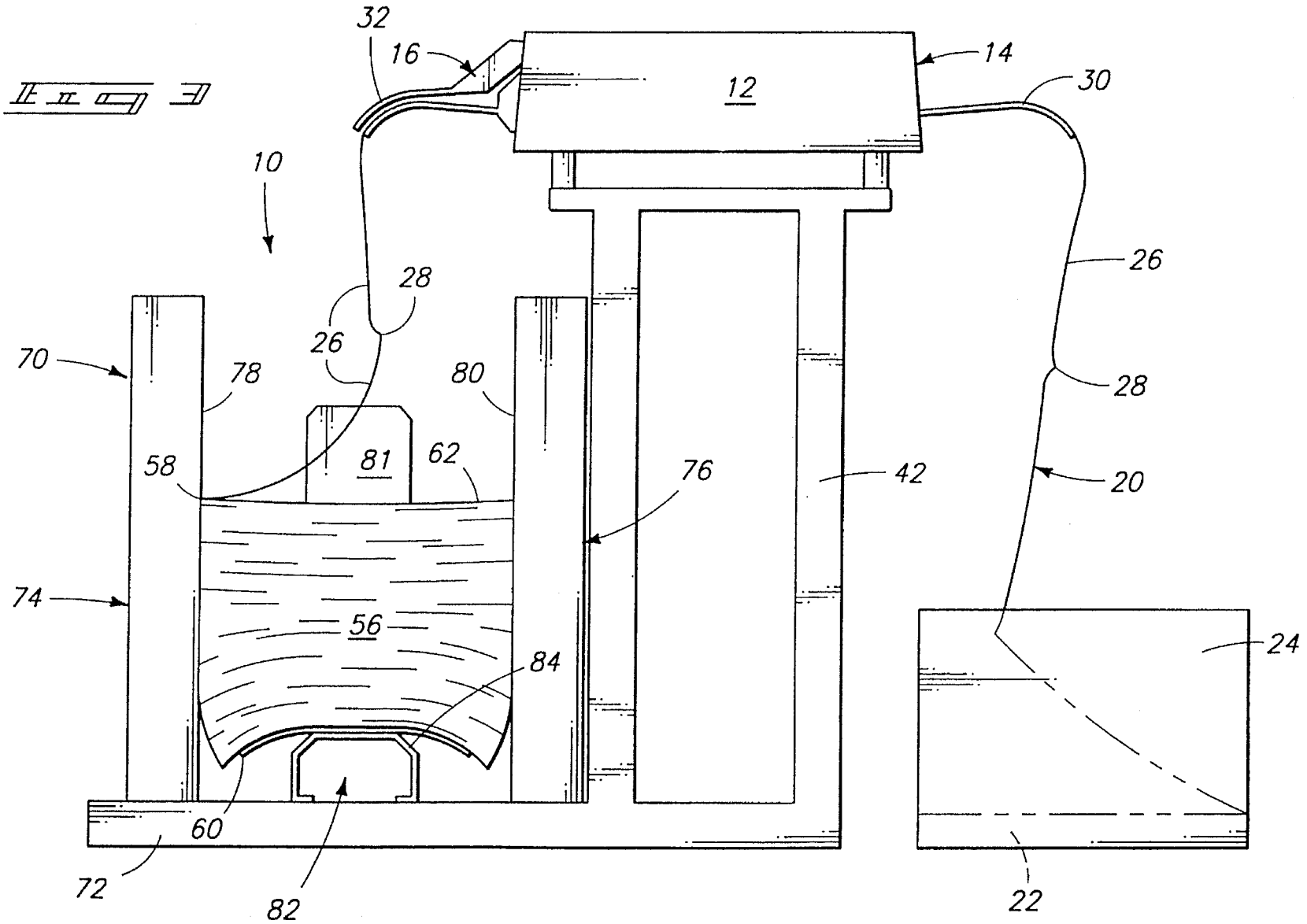
FIG. 3 is a side elevation view of a preferred embodiment of the present invention illustrating a printer outfeed collector having a unique resilient, paper support apparatus for maintaining a top layer of the restack relatively flat as additional layers or sheets are added.

A printer output paper collector, generally designated with the numeral 70, is illustrated in FIG. 3. The collector 70 is designed to operate in conjunction with a continuous form printer 12 that has the paper input section 14 and the paper output section 16. Preferably the continuous form printer 12 is an electrophotographic printer.

The collector 70 is designed to refold and restack fanfold or zigzag paper 20 that is discharged from the output section 16 of the printer 12 with the fold or crease lines transverse to the longitudinal dimension of the continuous fanfold paper 20. As previously mentioned, sheets or panels 26 are formed between the fold lines 28. Each sheet 26 has a prescribed length, frequently a standard 11.5 inches, in the longitudinal direction of the continuous form fanfold paper 20. However the present collector 70 is capable of restacking continuous forms 20 having sheet lengths different from the standard 11.5 inches.

The collector 70 has a base 72 that is generally floor-mounted. The collector 70 has opposing end walls 74 and 76 that are mounted on the base 72 for receiving and forming the restack of the fanfold paper 20. Although not illustrated, the end walls 74 and 76 are preferably adjusted with respect to each other to accommodate different length sheets 26. The end walls 74, 76 are spaced from each other in the longitudinal dimension of the continuous form 20 with the end walls 74, 76 having respective guide surfaces 78 and 80 adapted to receive the fold lines and guide and align each sheet 26 onto the top layer of the restack as the restack is being progressively formed. The guide surfaces 78, 80 maintain the restack in an upright orientation with the fold lines of each sheet or layer vertically aligned with fold lines of adjacent sheets 26 in the restack.

The collector 70 preferably includes a side wall 81 to receive side edges of each sheet 26 and a side opening to permit the restack of the fanfold paper to be removed when a desired height is reached.

Figure 1:
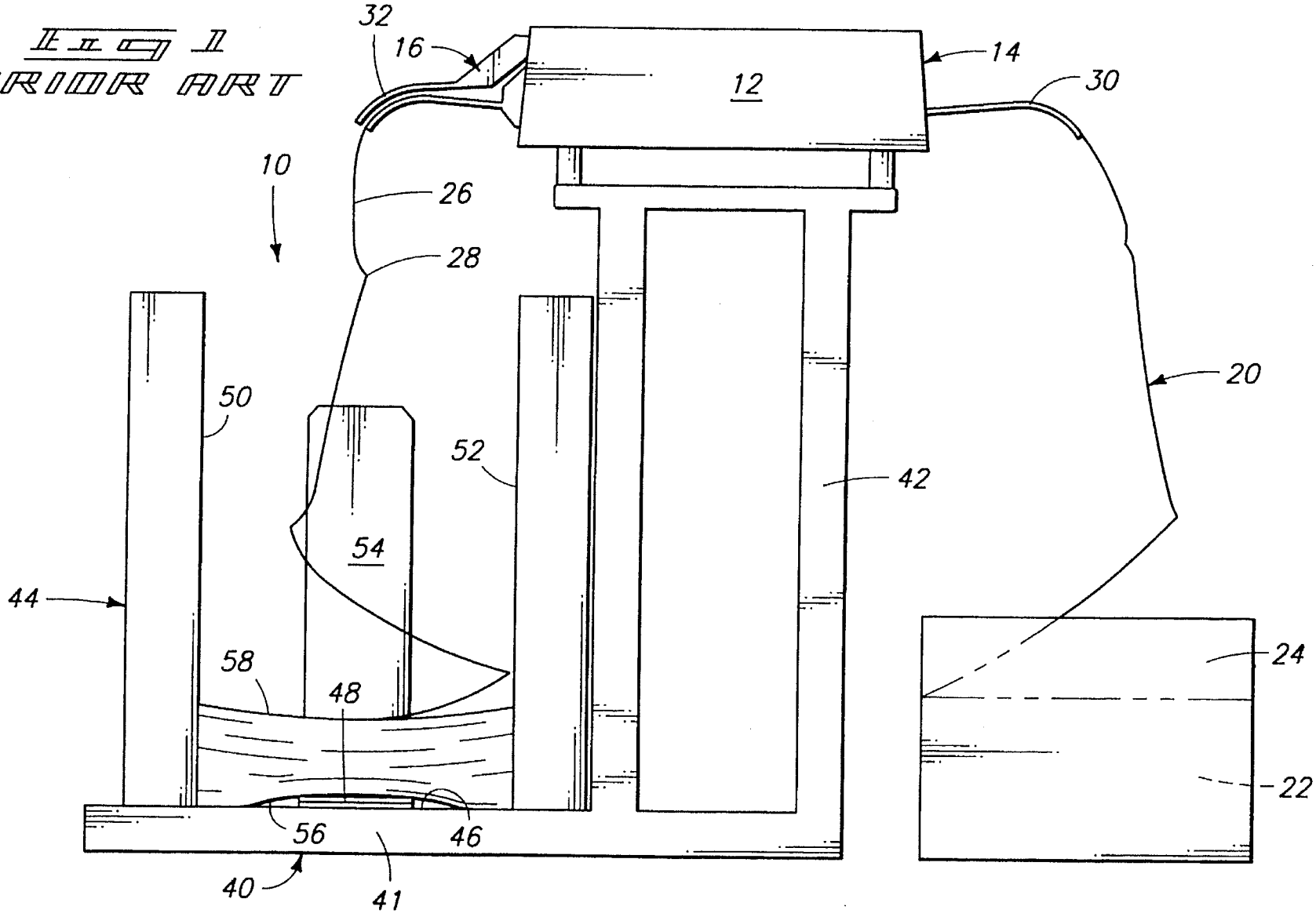
FIG 1 PRIOR ART
FIG. 1 is a side elevational view of a printer outfeed collector, illustrating fanfold paper being discharged from an outlet of a printer and into a prior art collector during an initial stage of a restack formation.
Figure 2:
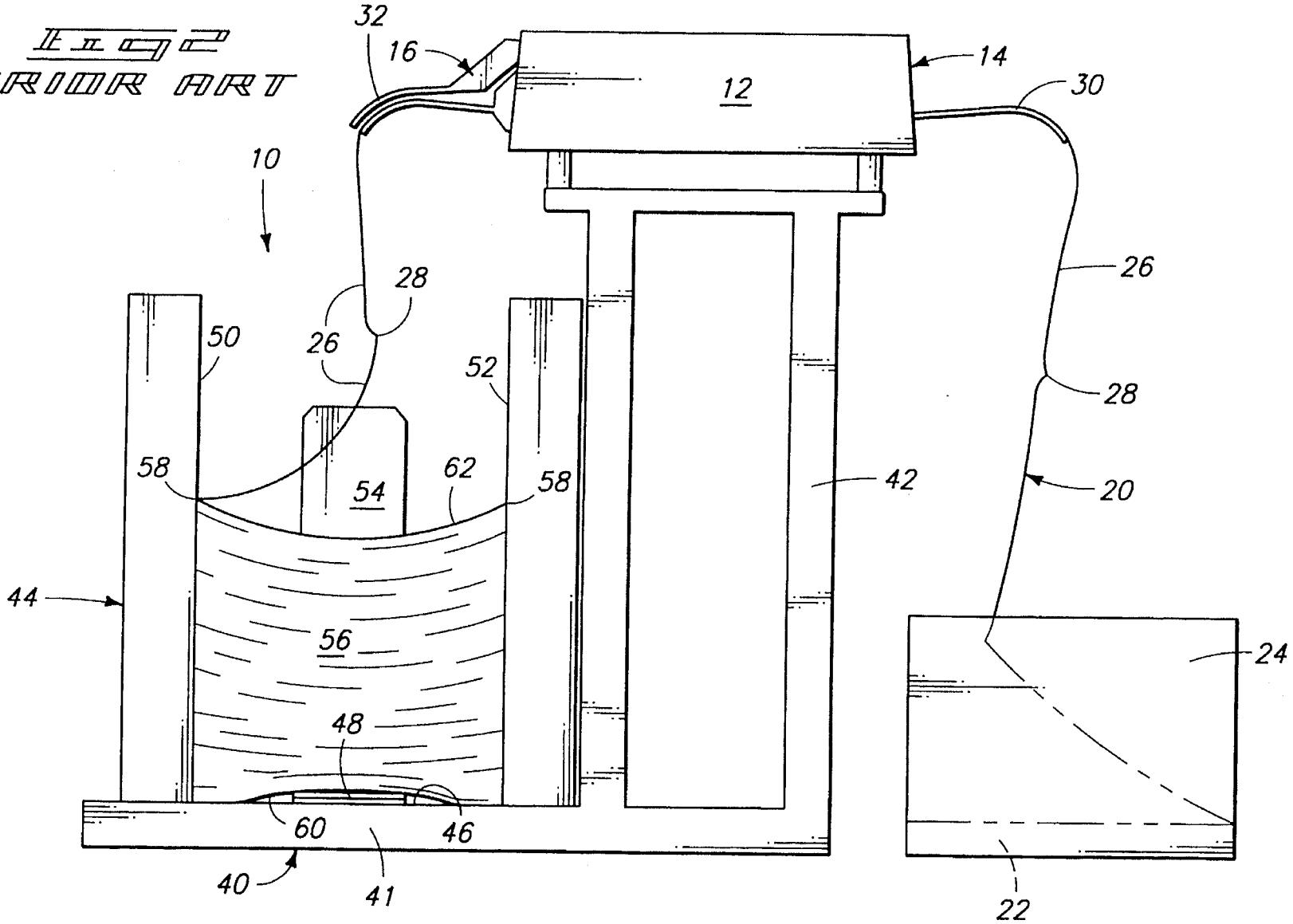
FIG 2 PRIOR ART
FIG. 2 is a side elevational view of the printer outfeed collector illustrated in FIG. 1, except showing the restack after many additional layers or sheets have been added to form a restack of substantial height.

The collector 70 further includes a resilient support assembly 82 for receiving the bottom layer 60 and supporting the restack on the base 72. The assembly 82 is designed to support the restack in such a manner as to maintain the top layer 62 relatively flat as illustrated in FIG. 3 as opposed to permitting the top layer to assume a substantial downward concave contour illustrated in FIGS. 1 and 2.

Figure 4:
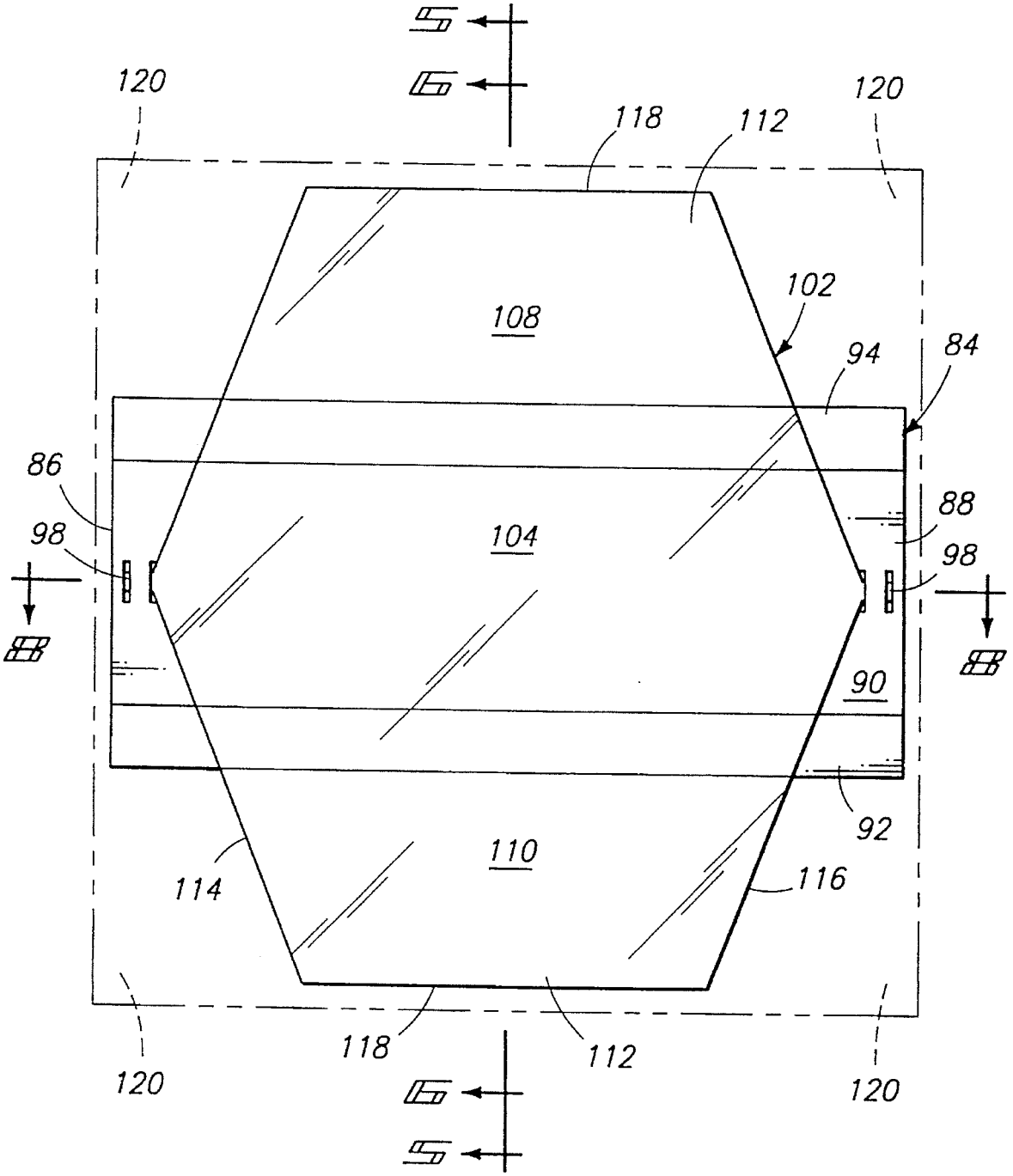
FIG. 4 is an isolated plan view of the resilient paper support apparatus.
Figure 11:
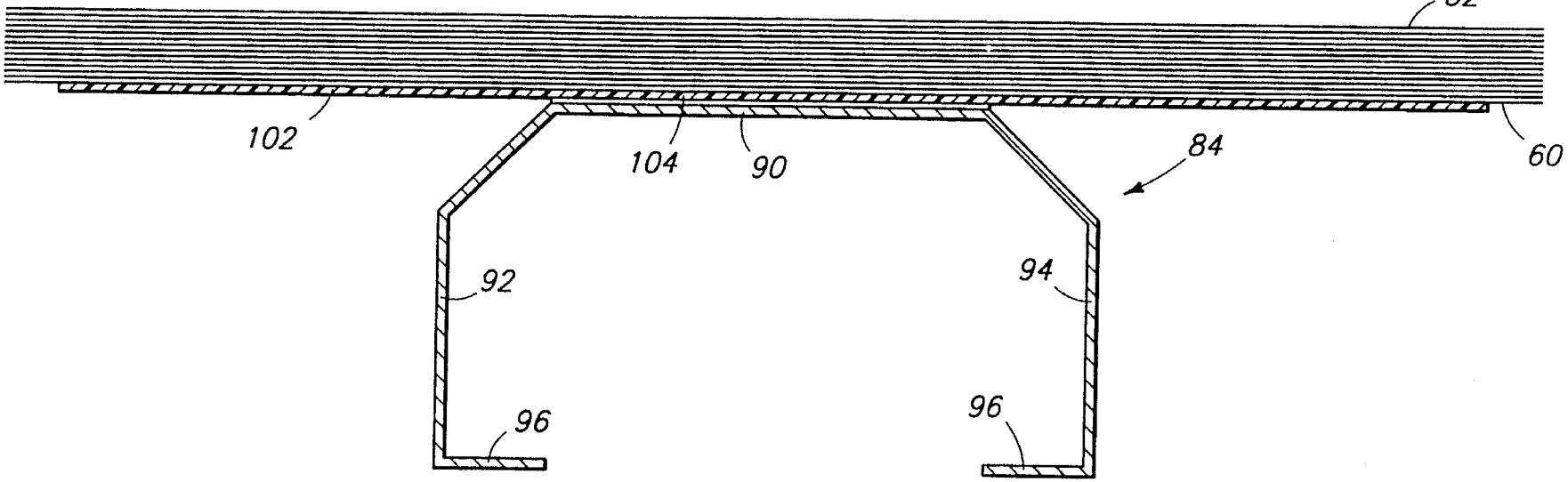
Figure 11:
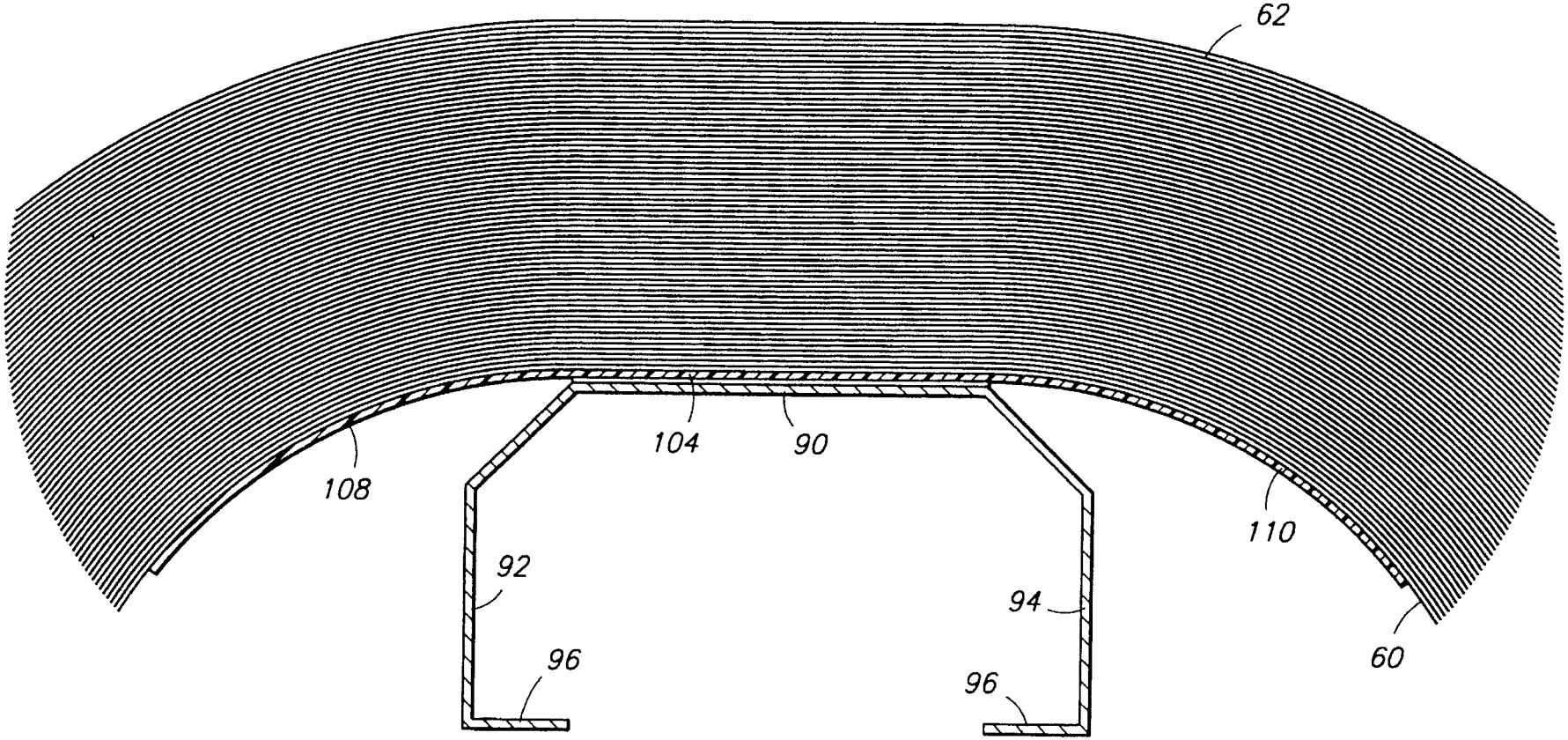
Figure 11:
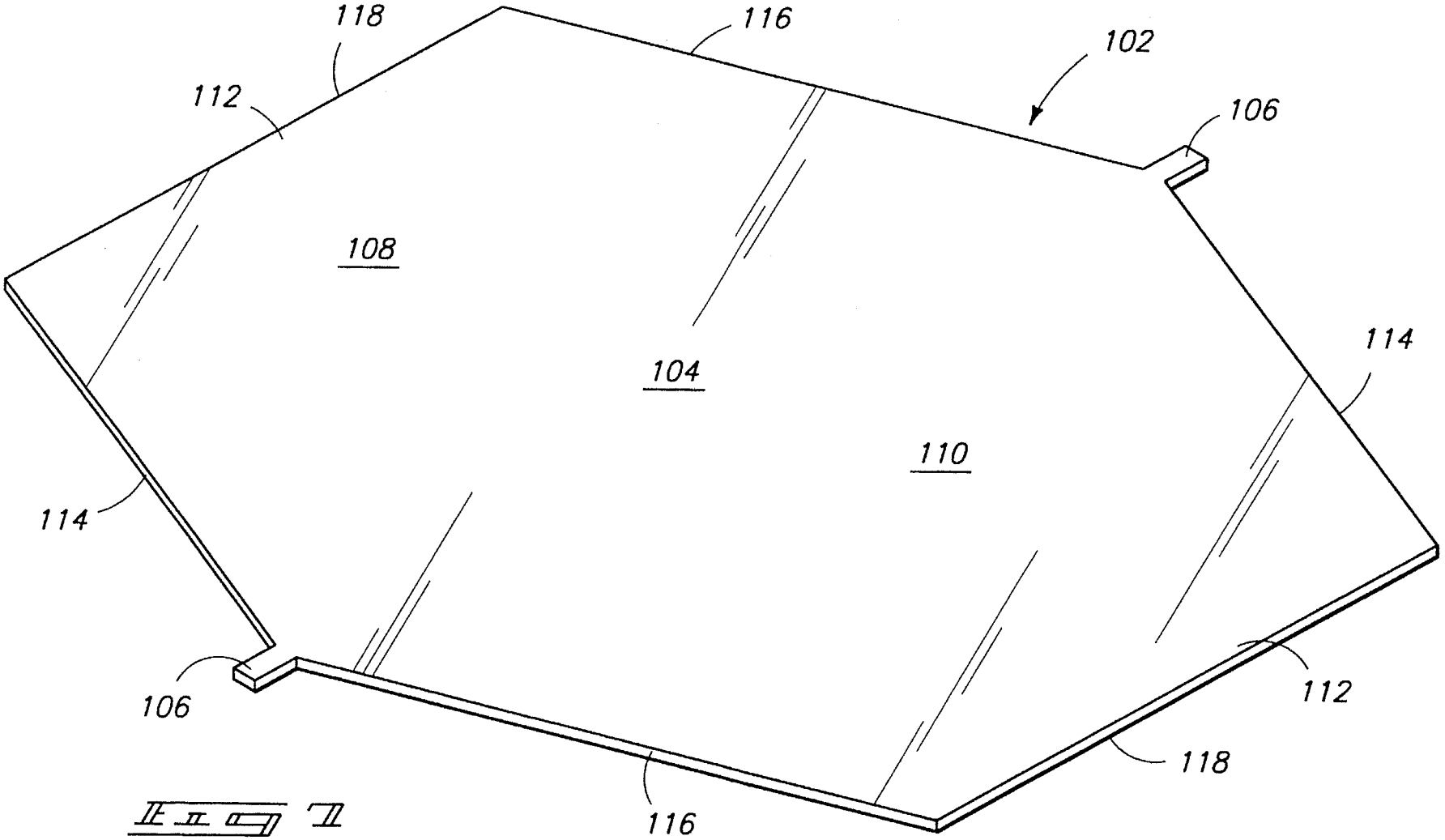
Figure 8:
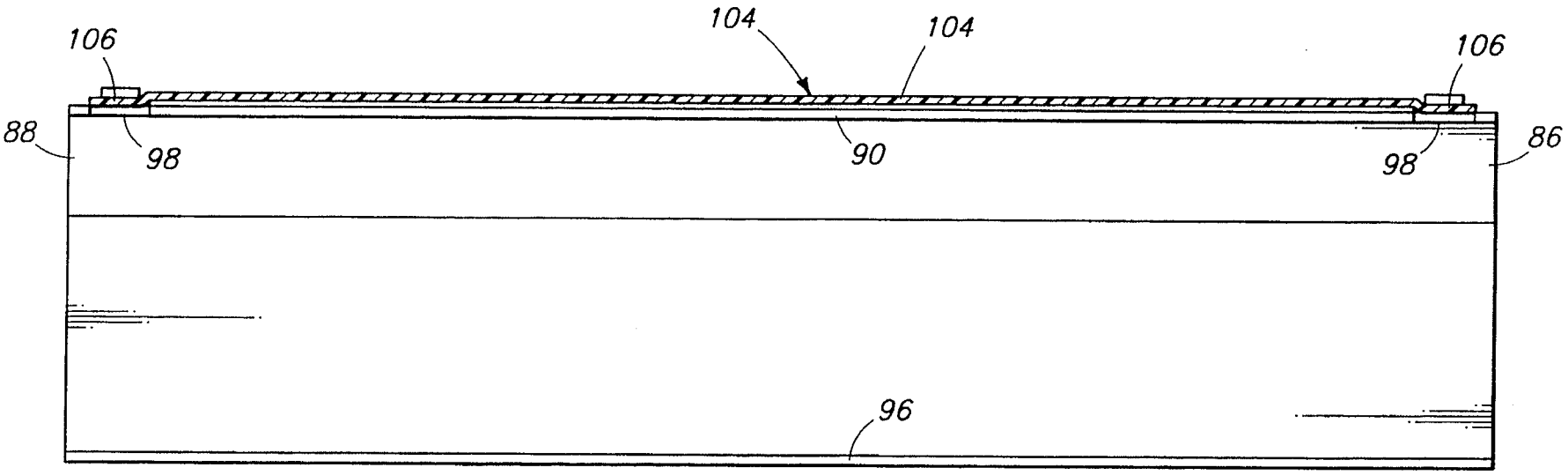
FIG. 8 is a vertical longitudinal cross-sectional view taken along line 8—8 in FIG. 4, illustrating attachment of the resilient support member on a central pedestal.

The resilient support assembly 82 includes a central pedestal or rail 84 that is attached or fixed to the base 72, intermediate the end walls 74, 76 for supporting a central part of the restack vertically above the base. Preferably the central pedestal 84 extends transverse to the longitudinal direction of the continuous form 20 and the length dimension of the sheets 26. The pedestal 84 extends between ends 86 and 88 as illustrated in FIGS. 4 and 8. In cross-section as illustrated in FIGS. 5 and 6, the pedestal has a rather inverted "U" shape, with a top wall 90, side walls 92 and 94, and flange feet 96. Attachment apertures 98 are formed in the top wall 90 as illustrated in FIG. 4. Preferably the central pedestal 84 is formed from a metal extrusion or from a metal sheet that is bent into the desired configuration.

The central pedestal 84 supports the central transverse part of the restack elevated above the base 72 causing the sheets to "break" in the center transverse to the sheet length and substantially parallel to the fold lines 28.

The resilient element assembly 82 further includes a resilient member that resiliently supports the restack adjacent the sheet ends. The resilient member is responsive to the weight of the restack adjacent the sheet ends to progressively move downward from the increased weight of the restack to maintain the upper layer(s) of the restack relatively flat as illustrated in FIG. 3 in comparison to the normal downward concave contour illustrated in FIGS. 1 and 2.

Preferably the resilient member comprises a flexible sheet element 102 made of plastic that is cut in the shape illustrated in FIG. 4. The flexible sheet element 102 has a central section 104 with side wing sections 108 and 110 that extend outward to the sides terminating in ends 112. The flexible sheet element 102 is preferably mounted on the central pedestal 84 with the central section 104 engaging the top wall 90 and the side sections 108 and 110 extending cantilevered from the central section 104 toward the end walls 74 and 76. The side wings 108 and 110 serve as cantilever spring elements that resiliently support the restack adjacent the fold lines 28. As the weight and height of the restack increases, the wing sections 108 and 110 progressively deflect downward enabling the lower layers of the restack, adjacent the fold lines 28, to move downward relative to the center portion of the restack to maintain the contour of the lop layer 62 relatively flat to facilitate re-bending of the sheets at their fold lines.

Each of the wing sections have progressively reduced widths with tapered side edges 114 and 116 extending from the central section 104 to an end edge 118. It should be noted that the tapered wings do not support corners 120 of the restack (see FIG. 4). Consequently, the corners 120 are allowed to droop further to counter the tendency of the fold lines to be more difficult to refold adjacent the corners compared to near the center of the fold line.

During operation, the initial layers or sheets 26 are held rather flat with the bottom layer engaging the flexible sheet member 102 as illustrated in FIG. 5. However as additional layers/sheets are added, the weight of the restack progressively increases causing the resilient elements or wings 108, 110 to deflect downward as illustrated in FIGS. 3 and 6. Preferably the amount of deflection is proportional to the weight of the restack to maintain the top layer 62 relatively flat to facilitate restacking into a neat and orderly restack.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A printer output paper collector for refolding and restacking fanfold paper discharged from a continuous form printer or the like into a restack, in which the fanfold paper has fold lines at prescribed intervals defining paper sheets therebetween of prescribed lengths extending along a longitudinal direction of the fanfold paper, comprising:

a base;

spaced guides associated with the base for receiving the fanfold paper discharged from the continuous form printer and assisting in the progressive refolding of the fanfold paper at the fold lines into a restack having a bottom sheet layer and a top sheet layer;

a pedestal supported on the base for supporting a central portion of the restack, a resilient support assembly between the spaced guides, responsive to the weight of the restack adjacent the fold lines, to maintain the top sheet layer relatively flat without a substantial downward concave contour between the fold lines as the restack is being progressively formed; and wherein the resilient support assembly has resilient spring elements adjacent opposite sides of the pedestal for resiliently supporting the restack adjacent the fold lines, in which the resilient spring elements progressively deflect downward relative to the pedestal to enable the fold lines of the lower sheet layer to move downward relative to a center of the lower sheet layer to maintain the top sheet layer substantially flat without a substantial downward concave contour between the fold lines as the restack is being progressively formed.

2. The printer output paper collector as defined in claim 1 wherein the resilient spring elements are cantilever leaf springs that extend outward from a central location toward the guides for supporting the restack adjacent the fold lines.

3. The printer output paper collector as defined in claim 1 wherein the resilient assembly includes (1) a central pedestal extending above the base for supporting a central portion of the restack, and (2) cantilever leaf springs supported on the pedestal and extending outward from the pedestal toward the guides for resiliently supporting the restack adjacent the fold lines to enable the fold lines of the bottom layer to move downward relative to the central portion of the restack to maintain the upper sheet layer relatively flat as the restack is being progressively formed.

4. The printer output paper collector as defined in claim 3 wherein the cantilever leaf springs are formed of a flexible sheet that is fixed to the central pedestal with sheet wings that extend cantilevered outward from the central pedestal terminating in outer ends adjacent the fold lines for supporting the restack adjacent the fold lines as the restack is being progressively formed.

5. The printer output paper collector as defined in claim 4 wherein the sheet wings have widths that decrease as the sheet wings extend outward from the central pedestal to the outer ends to increase the resiliency of the sheet wings.

6. The printer output paper collector as defined in claim 4 wherein the sheet wings have widths that progressively decrease as the sheet wings extend outward from the central pedestal to the outer ends to progressively increase the resiliency of the sheet wings.

7. The printer output paper collector as defined in claim 4 wherein the flexible sheet is comprised of flexible plastic sheet material.

8. The printer output paper collector as defined in claim 4 wherein the bottom sheet layer has fold corners and wherein the flexible sheet is contoured to leave the fold corners unsupported.

9. A printer output paper collector for refolding and restacking fanfold paper discharged from a continuous form printer or the like into a restack, in which the fanfold paper has fold lines at prescribed intervals defining paper sheets therebetween of prescribed lengths extending along a longitudinal direction of the fanfold paper, comprising:

a base;

end guides associated with the base spaced apart a distance substantially corresponding to a prescribed length of a paper sheet for receiving the fanfold paper discharged from the continuous form printer and assisting in the progressive refolding of the fanfold paper at the fold lines into a restack having a bottom sheet layer and a top sheet layer;

a resilient support assembly between the spaced guides, responsive to the weight of the restack adjacent the fold lines, to maintain the top sheet layer relatively flat without substantial downward concave contour between the fold lines as the restack is being progressively formed; and said resilient support assembly having (1) a central pedestal mounted on the base intermediate the end guides for supporting the restack as it is being formed, and (2) cantilever wings extending outward from the central pedestal toward the end guides in the longitudinal direction of the continuous form and responsive to the weight of the restack adjacent the fold lines for resiliently supporting the restack adjacent the fold lines.

* * * * *